US008944782B2

(12) United States Patent
Chuang

(10) Patent No.: US 8,944,782 B2
(45) Date of Patent: Feb. 3, 2015

(54) COMPACT MANUAL PUMP HAVING SELECTABLE LOW PRESSURE AND HIGH PRESSURE PUMPING MODES

(76) Inventor: Louis Chuang, Taichung (TW)

( * ) Notice: Subject to any disclaimer, the term of this patent is extended or adjusted under 35 U.S.C. 154(b) by 596 days.

(21) Appl. No.: 13/348,687

(22) Filed: Jan. 12, 2012

(65) Prior Publication Data

US 2013/0101453 A1 Apr. 25, 2013

(30) Foreign Application Priority Data

Oct. 20, 2011 (TW) ..... 100219681 A

(51) Int. Cl.
*F04B 9/14* (2006.01)
*F04B 33/00* (2006.01)

(52) U.S. Cl.
CPC ..... *F04B 33/00* (2013.01); *F04B 33/005* (2013.01); *F04B 9/14* (2013.01)
USPC ..... 417/374; 417/238

(58) Field of Classification Search
CPC ..... F04B 9/14; F04B 33/00; F04B 33/005
USPC ..... 417/236, 238, 374, 461
See application file for complete search history.

(56) References Cited

U.S. PATENT DOCUMENTS 4,057,176 A * 11/1977 Horvath ..... 222/175
2006/0119066 A1* 6/2006 Chuang ..... 280/201

FOREIGN PATENT DOCUMENTS

TW 228257 8/1994

* cited by examiner

*Primary Examiner* — Charles Freay
*Assistant Examiner* — Philip Stimpert
(74) *Attorney, Agent, or Firm* — Alan D. Kamrath; Kamrath IP Lawfirm, P.A.

(57) ABSTRACT

A compact manual pump includes a body, a valve assembly connected with the body, and a first cylinder assembly rotatable with respect to the body. The body includes first and second collect inlets, and an exhaust outlet. The first cylinder assembly includes a seat, first and second inflating inlets. While the first cylinder assembly is rotated to switch to low pressure pumping mode, the first inflating inlet is connected with the first collect inlet and the second inflating inlet is connected with the second collect inlet and the exhaust outlet is blocked by the seat. While the first cylinder assembly is rotated to switch to high pressure pumping mode, the first inflating inlet is connected with the first collect inlet and the second inflating inlet is connected with the exhaust outlet and the second collect inlet is blocked by the seat.

11 Claims, 15 Drawing Sheets

COMPACT MANUAL PUMP HAVING SELECTABLE LOW PRESSURE AND HIGH PRESSURE PUMPING MODES

BACKGROUND OF THE INVENTION

1. Field of the Invention

The present invention relates to a compact dual-mode manual pump such as for inflating and that in one mode provides a low pressure of air per pump stroke and in another mode provides a high pressure per stroke.

2. Description of the Related Art

Taiwan patent No. 228,257 discloses a pump including a head, an air duct connected with the head, a first cylinder, and a second cylinder. A valve joint is formed on an end of the head for connecting with a valve of a tire. The first cylinder is tubular and movable axially with respect to the air duct. The second cylinder receives and is movable axially with respect to the first cylinder. The air duct, the first and second cylinders form a tripartite telescopic design. A base formed in the second cylinder is selectable to couple with a base formed in the first cylinder to prove the pump to be selectable between low pressure and high pressure pumping modes.

However, this pump suffers some problems. One problem is that the first cylinder must be received in the second cylinder and the two bases must be coupled with each other to switch low pressure and high pressure pumping modes. It is time consuming to switch the pump between the two modes and any time loss would be crucial for a rider who is using the pump during the racing competition. Another problem is that the pump having a longer length so that using the pump in a narrow space is inconvenient.

The present invention is, therefore, intended to obviate or at least alleviate the problems encountered in the prior art.

SUMMARY OF THE INVENTION

According to the present invention, a compact manual pump having selectable low pressure and high pressure pumping modes includes a body, a valve assembly connected with the body, a first cylinder assembly rotatable with respect to the body to switch between low pressure and high pressure pumping modes, and a second cylinder assembly movable reciprocally with the first cylinder assembly to induce air from the atmosphere. The body includes first and second collect inlets, and an exhaust outlet. The first cylinder assembly includes a seat, first and second inflating inlets. While the first cylinder assembly is rotated to switch to low pressure pumping mode, the first inflating inlet is connected with a first collect inlet and the second inflating inlet is connected with a second collect inlet and an exhaust outlet is blocked by the seat. While the first cylinder assembly is rotated to switch to high pressure pumping mode, the first inflating inlet is connected with the first collect inlet and the second inflating inlet is connected with the exhaust outlet and the second collect inlet is blocked by the seat.

In view of the foregoing, it is an object of the present invention that the compact manual pump is selectable for low pressure and high pressure pumping modes.

It is another object of the present invention that the first cylinder assembly is rotatable with respect to the body to immediately switch to low pressure and high pressure pumping modes It is a further object of the present invention that the compact manual pump is compact and can create a flush outlook for aesthetic reason.

BRIEF DESCRIPTION OF THE DRAWINGS

For the present disclosure to be easily understood and readily practiced, the present disclosure will now be described for the purpose of illustration not limitation, in conjunction with the following figures, wherein.

Figure 1:
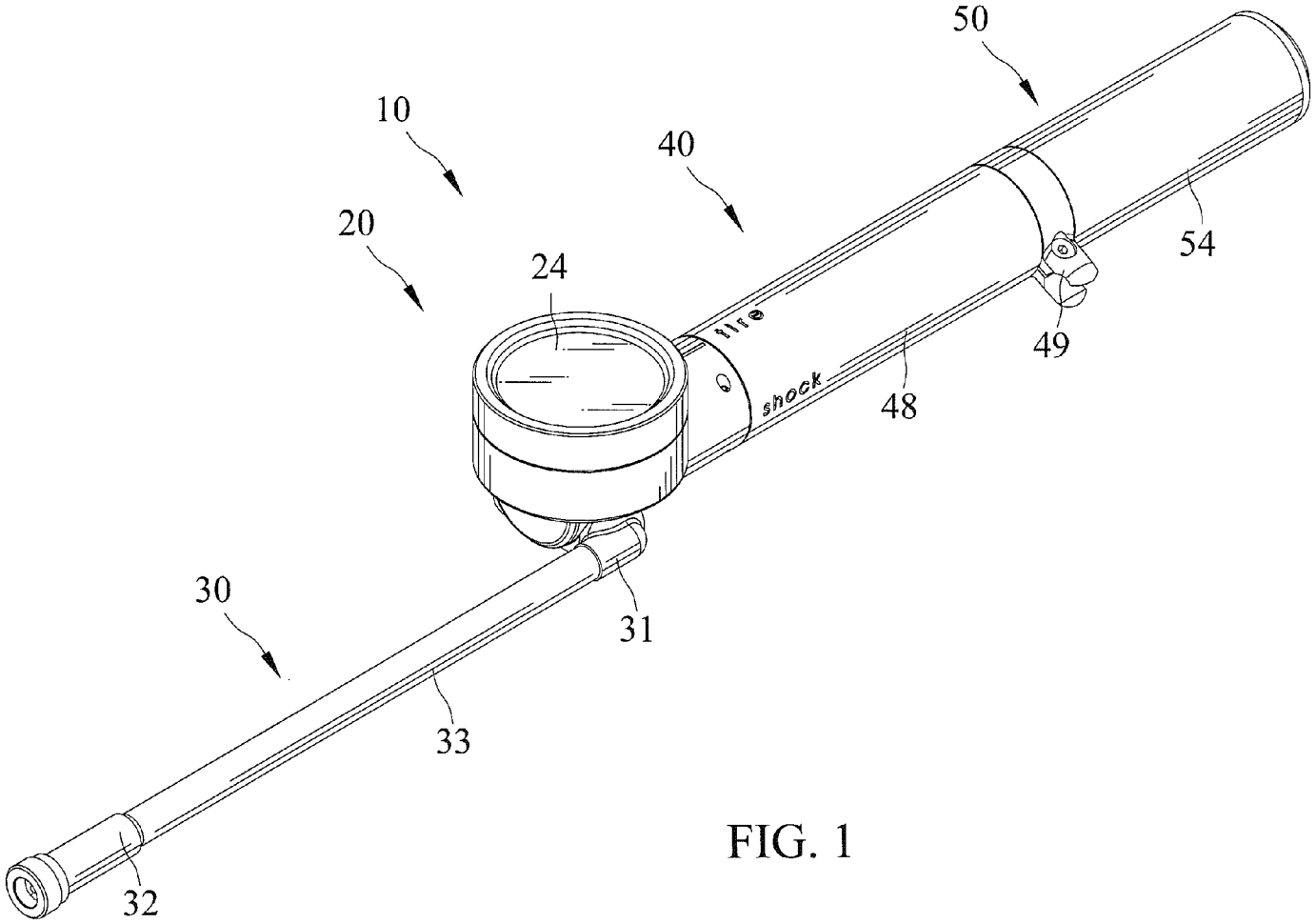
FIG. 1 is a perspective view of a compact manual pump in accordance with the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

Figure 2:
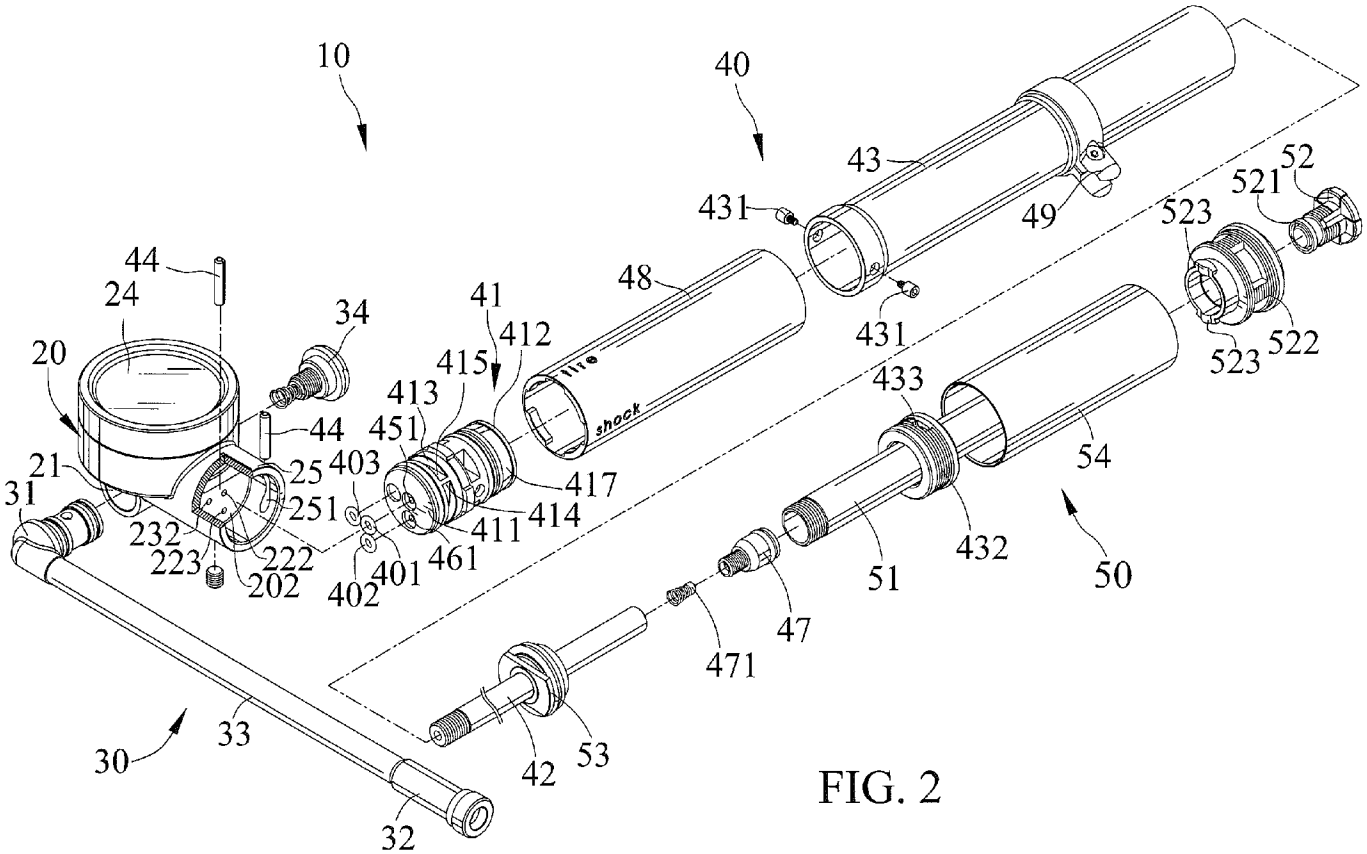
FIG. 2 is an exploded view of the compact manual pump of FIG. 1.
Figure 3:
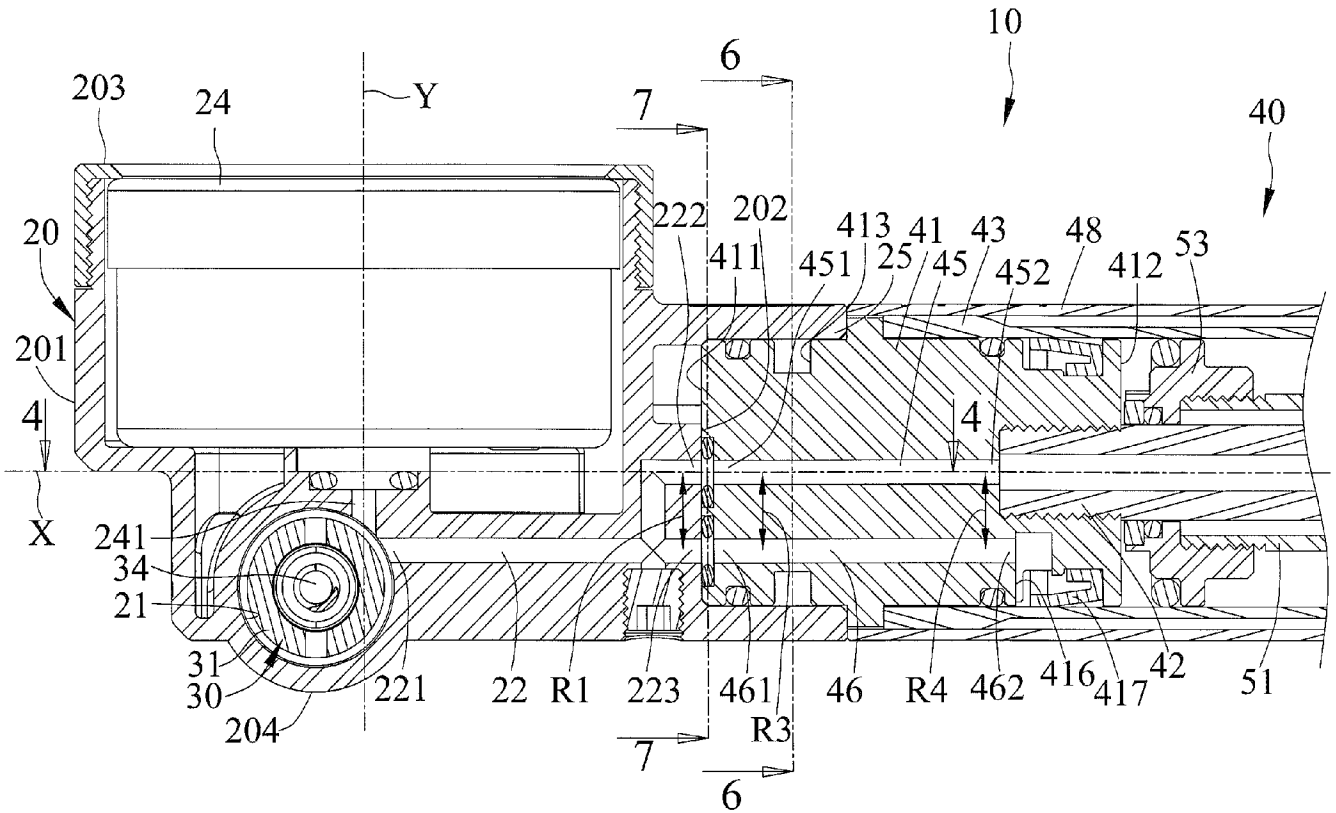
FIG. 3 is a partial, enlarged cross sectional view of FIG. 1.
Figure 4:
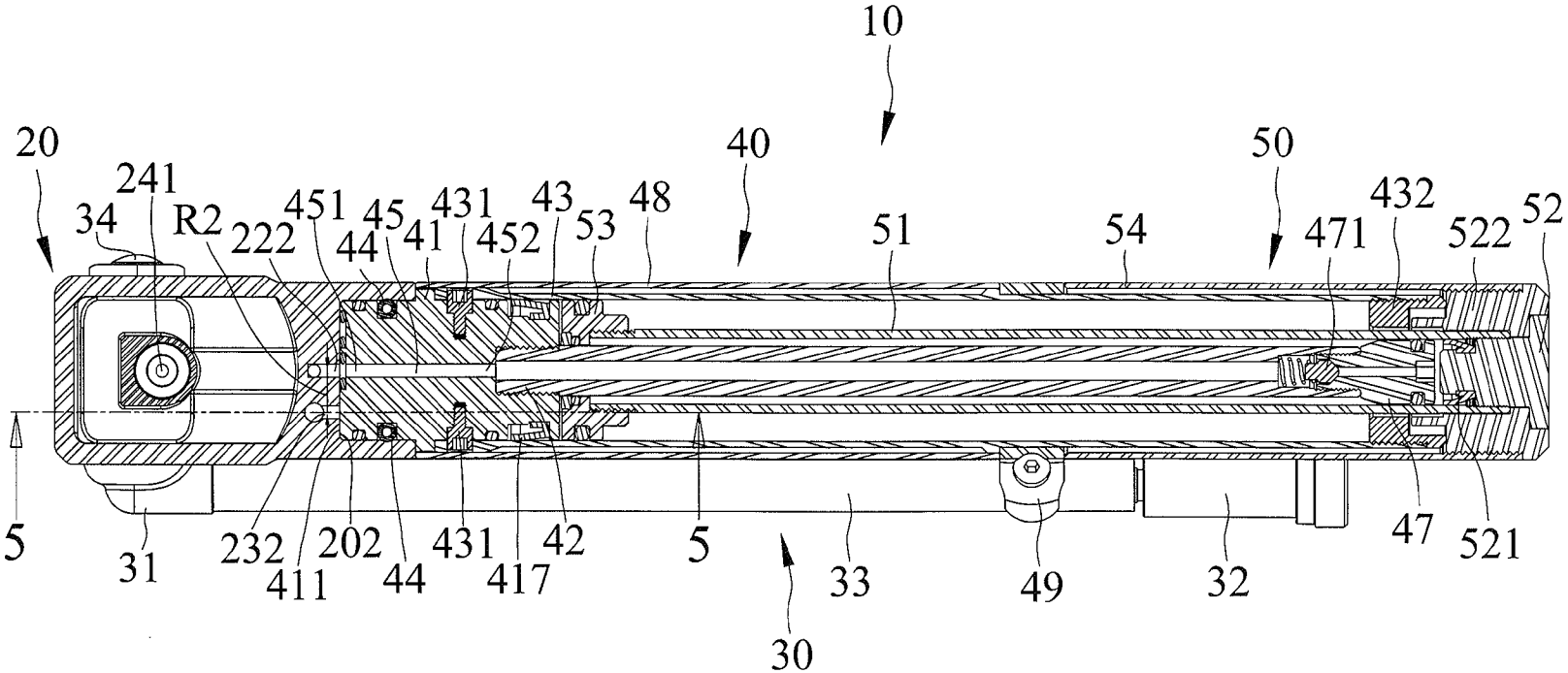
FIG. 4 is a cross-sectional view taken along line 4-4 of FIG. 3.
Figure 5:
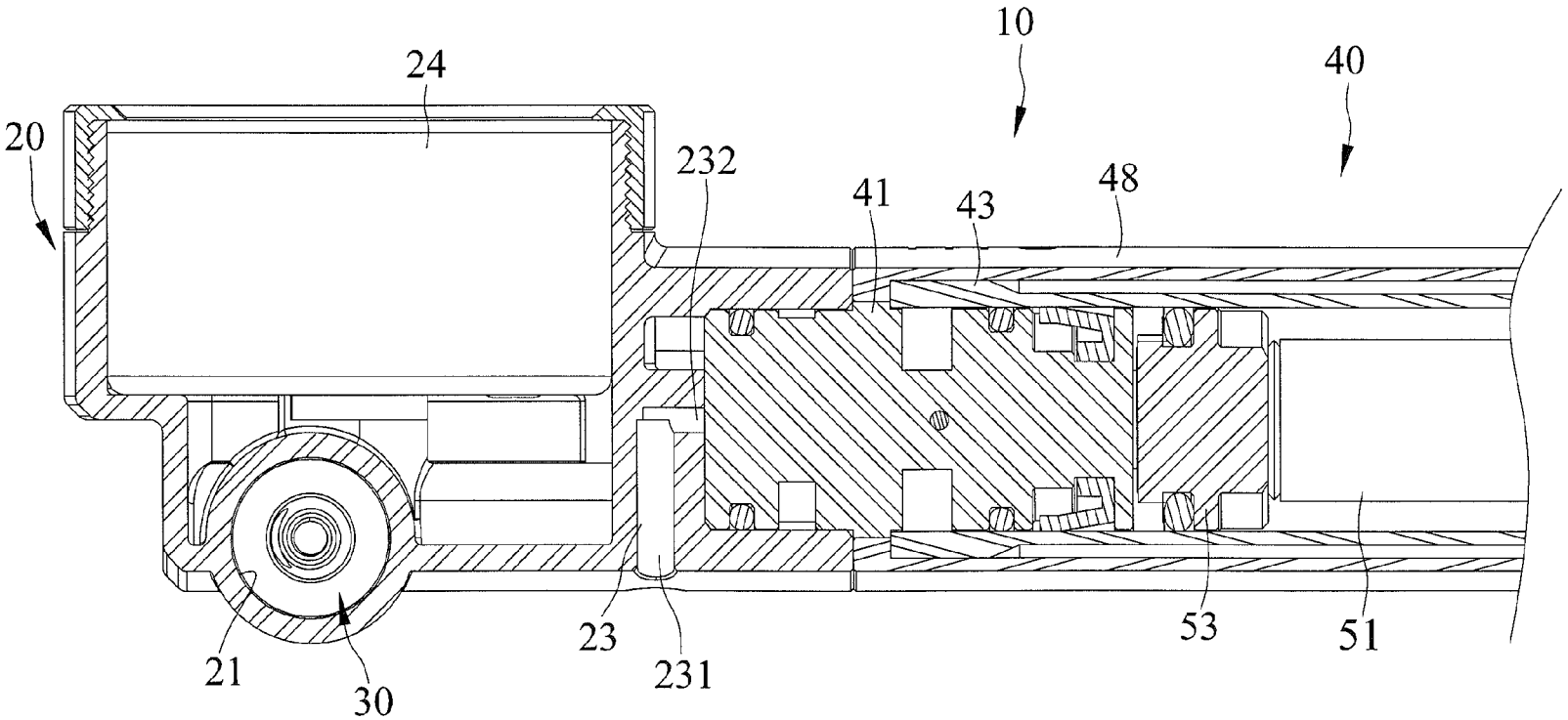
FIG. 5 is a cross-sectional view taken along line 5-5 of FIG. 4.
Figure 6:
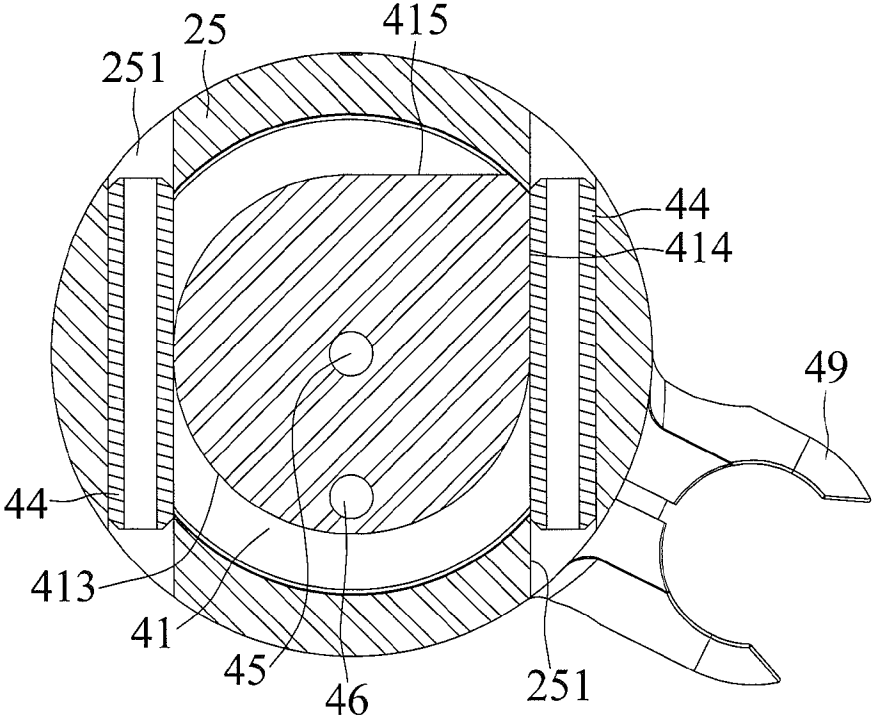
FIG. 6 is a cross-sectional view taken along line 6-6 of FIG. 3.
Figure 7:
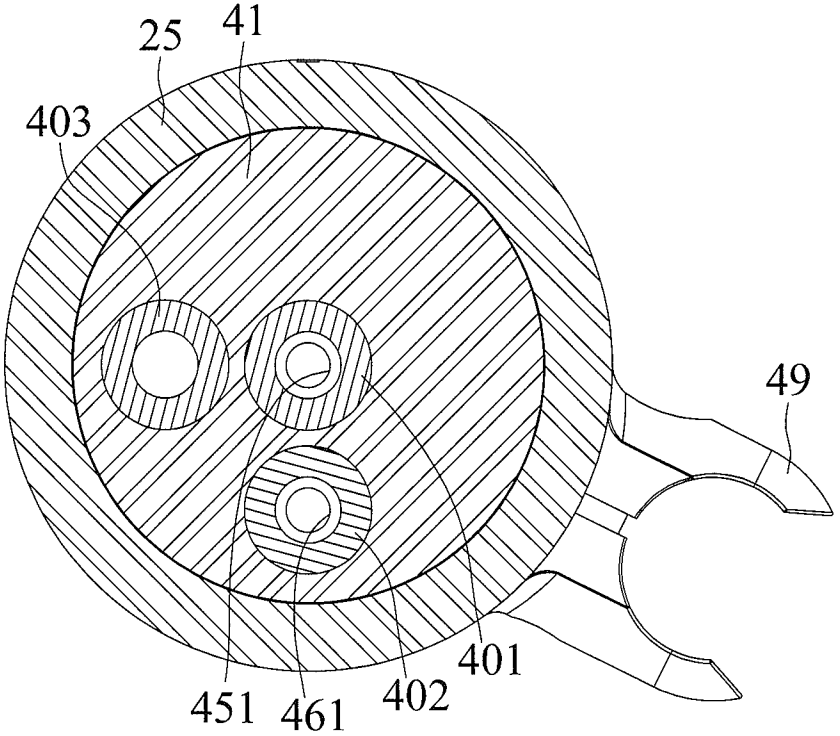
FIG. 7 is a cross-sectional view taken along line 7-7 of FIG. 3.
Figure 8:
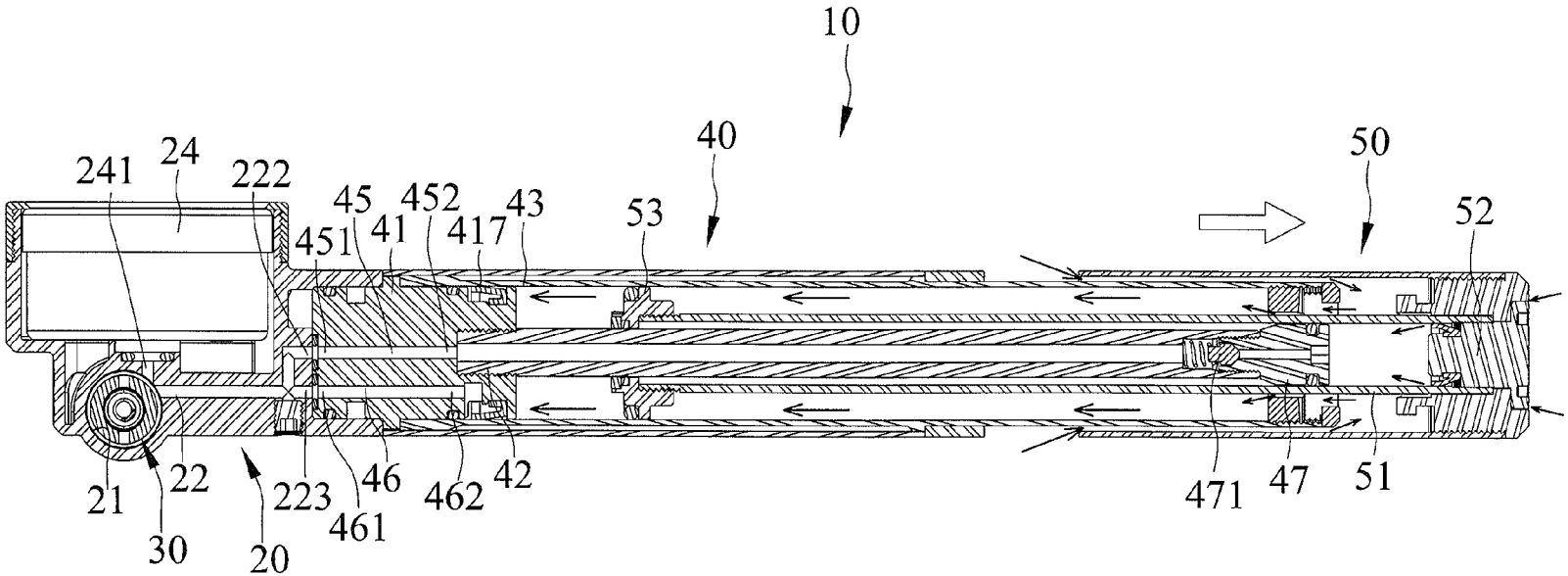
FIG. 8 is a cross-sectional view showing the compact manual pump of FIG. 1 switched to the low pressure pumping mode and suctioning air.
Figure 9:
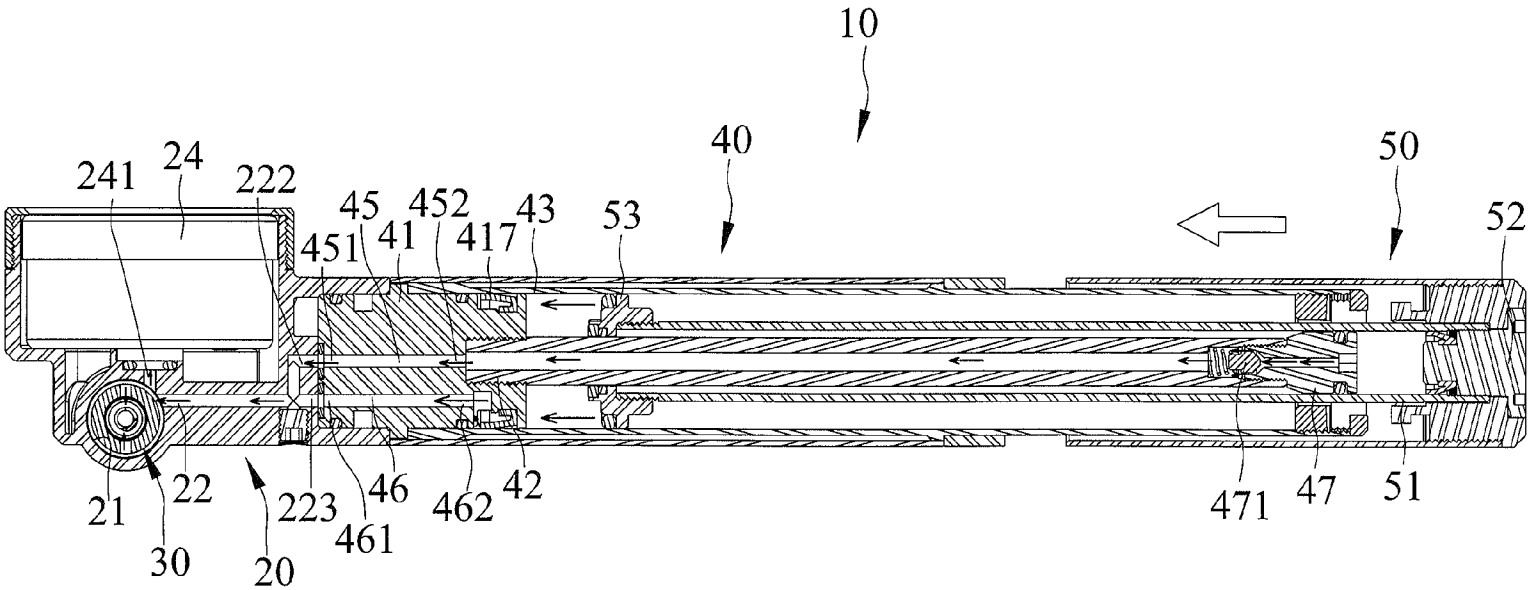
FIG. 9 is a cross-sectional view showing the compact manual pump of FIG. 1 switched to the low pressure pumping mode and aerating air.

Referring to FIGS. 1 through 9, a compact manual pump 10 in accordance with the present invention generally includes a body 20, a valve assembly 30, a first cylinder assembly 40, and a second cylinder assembly 50. The first cylinder assembly 40 is rotatable with respect to the body 20 to switch low pressure or high pressure pumping mode.

The body 20 is defined first and second axes X and Y extending therein and the second axis Y is vertically intersected with the first axis X. The body 20 has first, second, third, and fourth ends 201, 202, 203 and 204. The first and second ends 201 and 202 extend along the first axis X and are disposed opposite to each other. The third and fourth ends 203 and 204 extend along the second axis Y and are disposed opposite to each other. The body 20 includes a chamber 21 disposed adjacent to the fourth end 204, collect and exhaust channels 22 and 23 disposed separately, and a pressure gauge 24 disposed at the third end 203. The chamber 21 is located at the first end 201 and passes through two opposite sides of the body 20. The chamber 21 further includes an axis extending through two opposite ends thereof and disposed vertical with and not intersected with the first and second axes X and Y. The collect channel 22 includes a collect outlet 221 connected with the chamber 21, first and second collect inlets 222 and 223 disposed adjacent to the second end 202. An axis of the first collect inlet 222 is located along the first axis X, and an axis of the second collect inlet 223 is located at a first position radially spaced from the first axis X. A first radial distance R1 is defined between the axis of the first collect inlet 222 and the axis of the second collect inlet 223. The exhaust channel 23 includes an exhaust inlet 231 connected with an exterior surface of the body 20 and an exhaust outlet 232 disposed at the second end 202. An axis of the exhaust outlet 232 is located at a second position radially spaced from the first axis X. A second radial distance R2 is defined between the axis of the exhaust outlet 232 and the axis of the first collect inlet 222. The second radial distance R2 is equal to the first radial distance R1. An included angle formed between the first and second radial distances R1 and R2 is 90 degrees. The pressure gauge 24 includes a pressure channel 241 connected with the chamber 21.

The valve assembly 30 includes a joint 31, a nozzle head 32, and a flexible tube 33 connected between the joint 31 and the nozzle head 32. The joint 31 is L-shaped and pivotally connected with the chamber 21 by a fastener 34, so that a user can rotate the nozzle head 32 to a suiting position for connecting a valve allowed to inflate.

The first cylinder assembly 40 is pivotally connected with the second end 202 of the body 20, and rotatable with respect to the body 20 about the first axis X to switch between low pressure and high pressure pumping modes. The first cylinder assembly 40 includes a seat 41, inner and outer cylinders 42 and 43. An inner diameter defined in the inner cylinder 42 is less than an inner diameter defined in the outer cylinder 43. The seat 41 includes pivoting and connecting ends 411 and 412 extending along the first axis X and disposed opposite to each other. The pivoting end 411 is pivotally connected with the second 202 of the body 20. A non-circular shaped groove 413 is formed at a peripheral edge of the pivoting end 411. An annular wall 25 is formed at the second 202 of the body 20 and adapted to surround the peripheral edge of the pivoting end 411. The annular wall 25 includes two through holes 251 disposed opposite to the groove 413. The two through holes 251 are disposed extending towards a longitudinal direction extending parallel to the second axis Y and penetrating to the annular wall 25. A pair of restricting pin 44 is disposed through the through holes 251 and the groove 413, respectively to limit the seat 41 rotatable in the annular wall 25 and not slidable along the first axis X. Thus, the first cylinder assembly 40 cannot depart from the body 20. The groove 413 includes first and second level sides 414 and 415 selectively abutted against the pair of restricting pin 44 respectively. When the first cylinder assembly 40 is switched to low pressure pumping mode, the first level side 414 is abutted against the restricting pin 44. The first and second level sides 414 and 415 extend longitudinally to form an included angle equal to 90 degrees, so that the seat 41 is able to be rotated with respect to the body 20 about 90 degrees. The seat 41 includes first and second inflating channels 45 and 46 not connected with each other therein. The first inflating channel 45 includes a first inflating inlet 451 disposed at the pivoting end 411 and a first inflating outlet 452 disposed at the connecting end 412. An axis defined in the first inflating inlet 451 is extends along the first axis X, so that the first inflating inlet 451 is connected with the first collect inlet 222. An axis defined in the first inflating outlet 452 is located on the first axis X, so that the first inflating outlet 452 is connected with the inner cylinder 42. The second inflating channel 46 includes a second inflating inlet 461 and a second inflating outlet 462. A third radial distance R3 is defined between an axis defined in the second inflating inlet 461 and the axis defined in the first inflating inlet 451. A fourth radial distance R4 is defined between an axis defined in the second inflating outlet 462 and the axis defined in the first inflating outlet 452. The third radial distance R3 is equal to the fourth radial distance R4, and the third radial distance R3 is equal to the first radial distance R1. Hence, the first cylinder assembly 40 is rotatable with respect to the body 20 to make the second inflating inlet 461 selectively connect with the second collect inlet 223 or the exhaust outlet 232, so that the first cylinder assembly 40 is switched to low pressure or high pressure pumping mode. An end of the inner cylinder 42 is connected with the a central portion of the connecting end 412 of the seat 41, and a axis defined in the inner cylinder 42 and the first axis X are collinear, so that the first inflating outlet 452 is connected and communicated with the inner cylinder 42. The inner cylinder 42 includes a first piston 47 disposed opposite to the seat 41 therein. A check valve 471 for backflow prevention is mounted between the first piston 47 and the inner cylinder 42. An end of the outer cylinder 43 is connected with a periphery of the connecting end 412 of the seat 40 by two screws 431. The outer cylinder 43 includes a first cap 432 disposed opposite to the seat 41. At least one slot 433 is formed in the first cap 432. The seat 41 further includes an annular trough 416 formed on the periphery of the connecting end 412 and a first non-return ring 417 for backflow prevention mounted between the annular trough 416 and the outer cylinder 43.

The second cylinder assembly 50 is movable reciprocally with respect to the first cylinder assembly 40 to induce air from the atmosphere into the first and second cylinder assemblies 40 and 50. The second cylinder assembly 50 includes a hollow bar 51, an intake valve 52 mounded on an end of the hollow bar 51, and a second piston 53 mounded on another end of the hollow bar 51. The second piston 53 is disposed between the inner and outer cylinders 42 and 43 to provide the hollow bar 51 securely located between the inner and outer cylinders 42 and 43. An inner surface of the hollow bar 51 is contacted with a periphery surface of the first piston 47 to allow air flowing through the first piston 47 in only one direction, and inner and outer surfaces of the second piston 53 is respectively contacted with the inner and outer cylinders 42 and 43 to allow air flowing through the inner and outer cylinders 42 and 43 in only one direction. A second non-return ring 521 is mounted between the intake valve 52 and the hollow bar 51 to prevent air flowing from the hollow bar 51 to the atmosphere. A second cap 522 is mounted on a periphery of the intake valve 52. An end of the second cap 522 is connected with at least one block 523 selectively engaged with the at least one slot 433 to provide the second cylinder assembly 50 selectively located at and not movable reciprocally with respect to the first cylinder assembly 40. A first sleeve 48 is disposed on a periphery of the first cylinder assembly 40, and a second sleeve 54 is disposed on a periphery of the second cylinder assembly 50. Hence, an external diameter defined on the first sleeve 48 is equal to an external diameter defined on the second sleeve 54, so that the appearance of the compact manual pump 10 is compact and can create a flush outlook for aesthetic reason. The first sleeve 48 is rotatable by the user to switch low pressure or high pressure pumping mode. The second sleeve 54 is holdable by the user. A clamp 49 is mounted on the periphery of the first cylinder assembly 40 to fix the flexible tube 33.

While the first cylinder assembly 40 is rotated to switch to low pressure pumping mode, the first inflating inlet 451 is connected with the first collect inlet 222, and the second inflating inlet 461 is connected with the second collect inlet 223, and the exhaust outlet 232 is blocked by the seat 41. While the first cylinder assembly 40 is rotated to switch to high pressure pumping mode, the first inflating inlet 451 is connected with the first collect inlet 222, and the second inflating inlet 461 is connected with the exhaust outlet 232, and the second collect inlet 223 is blocked by the seat 41.

The first cylinder assembly 40 further includes first, second, and third airtight rings 401, 402, and 403 disposed between the pivoting end 411 of the seat 41 and the second end 202 of the body 20. While the first cylinder assembly 40 is rotated to switch to low pressure pumping mode, the first airtight ring 401 is disposed between the first inflating inlet 451 and the first collect inlet 222, and the second airtight ring 402 is disposed between the second inflating inlet 461 and the second collect inlet 223 to provide airtightness. While the first cylinder assembly 40 is rotated to switch to high pressure pumping mode, the first airtight ring 401 is disposed between the first inflating inlet 451 and the first collect inlet 222, and the second airtight ring 402 is disposed between the second inflating inlet 461 and the exhaust outlet 232, and the third airtight ring 403 is disposed between the pivoting end 411 and the second collect inlet 223 to provide airtightness.

While the first cylinder assembly 40 is rotated to switch to low pressure pumping mode, the second cylinder assembly 50 is moved opposite to the first cylinder assembly 40 to induce air from the atmosphere passing through the second piston 53 into the outer cylinder 43 and a space formed between the inner cylinder 42 and the seat 41. Simultaneously, air is induced passing through the intake valve 52 into a space formed between the hollow bar 51 and the first piston 47. While the first cylinder assembly 40 is rotated to switch to low pressure pumping mode, the second cylinder assembly 50 is moved to close to the first cylinder assembly 40, air in the second piston 53, the outer cylinder 43, and the space formed between the inner cylinder 42 and the seat 41 is urged past the first non-return ring 417, so that air passes through the second inflating outlet 462, the second inflating channel 46, the second inflating inlet 461, and the second collect inlet 223 into the collect channel 22. Simultaneously, air in the space formed between the hollow bar 51 and the first piston 47 passes through the check valve 471, the inner cylinder 42, the first inflating outlet 452, the first inflating channel 45, the first inflating inlet 451, and the first collect inlet 222 into the collect channel 22. Because the collect channel 22 collects air flowing from the first and second inflating channel 45 and 46 so that the compact manual pump 10 is able to inflate an object by the valve assembly 30 for low pressure/high volume pumping operation. Additionally, while air flows through the pressure channel 241, the pressure gauge 24 provides to measure air pressure. Generally, the compact manual pump 10 switched to low pressure pumping mode is used with a tire.

Figure 10:
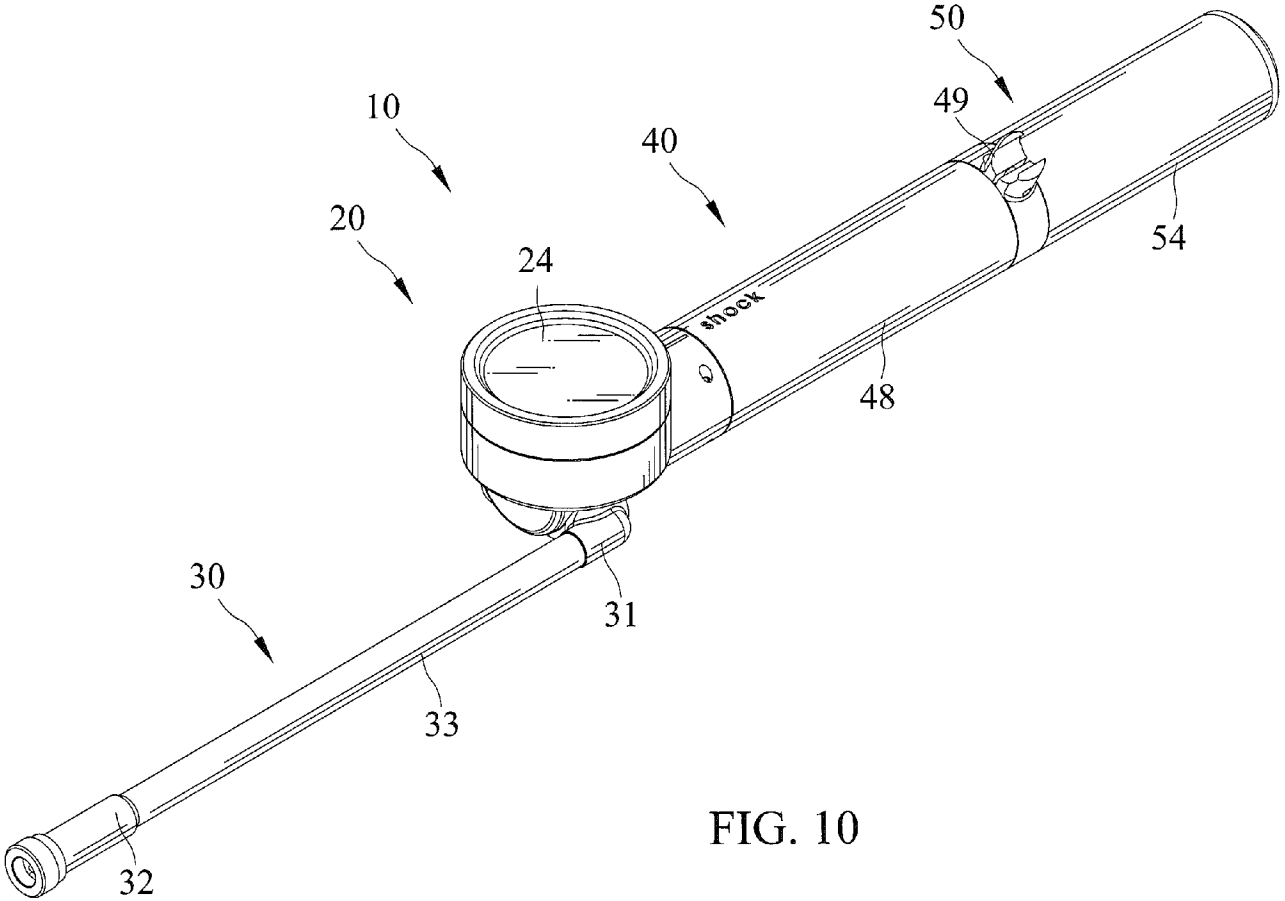
FIG. 10 is a perspective view of FIG. 1 showing the compact manual pump switched to high pressure pumping mode.
Figure 11:
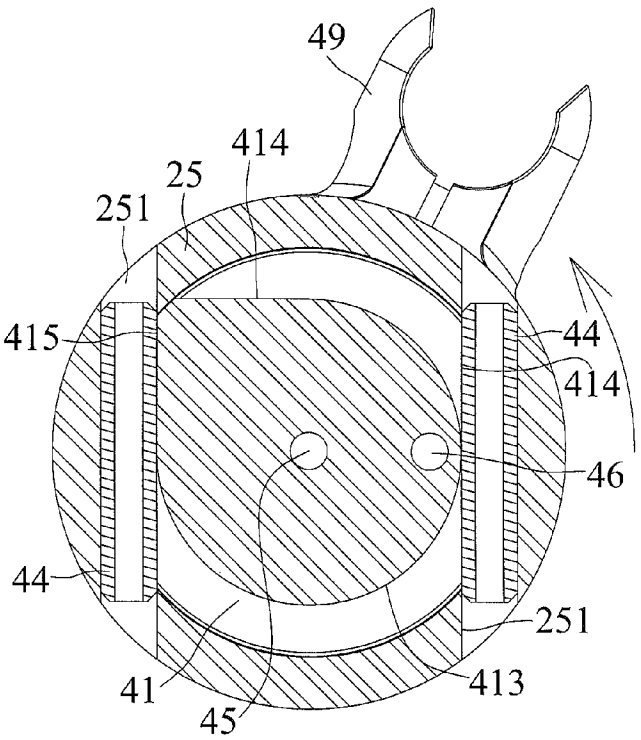
FIG. 11 is a cross sectional view of FIG. 10.
Figure 12:
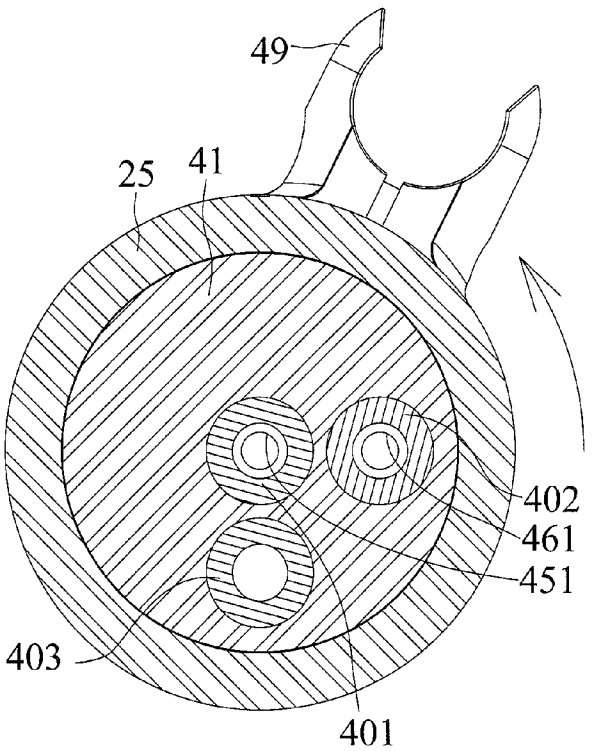
FIG. 12 is another cross sectional view of FIG. 10.
Figure 13:
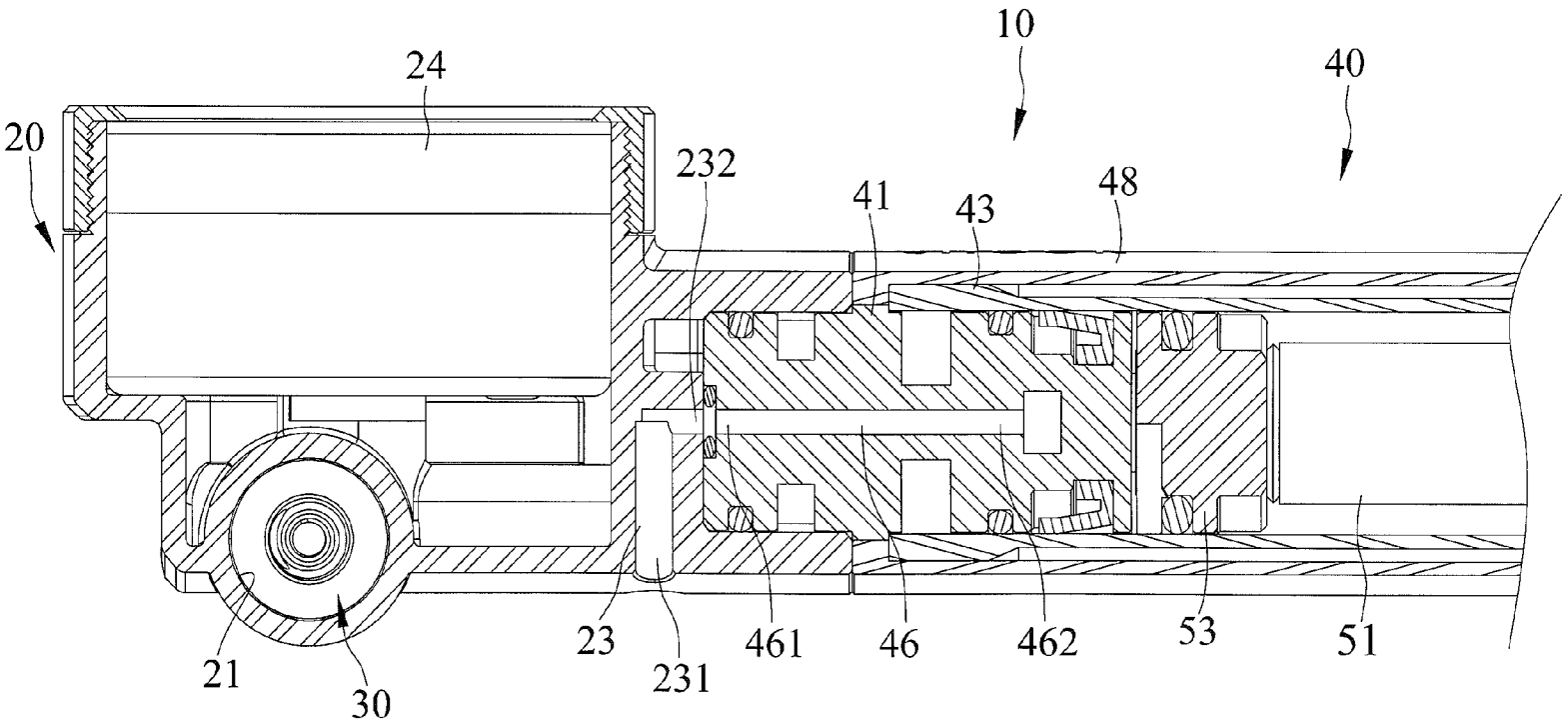
FIG. 13 is a partial, enlarged cross sectional view of FIG. 10.
Figure 14:
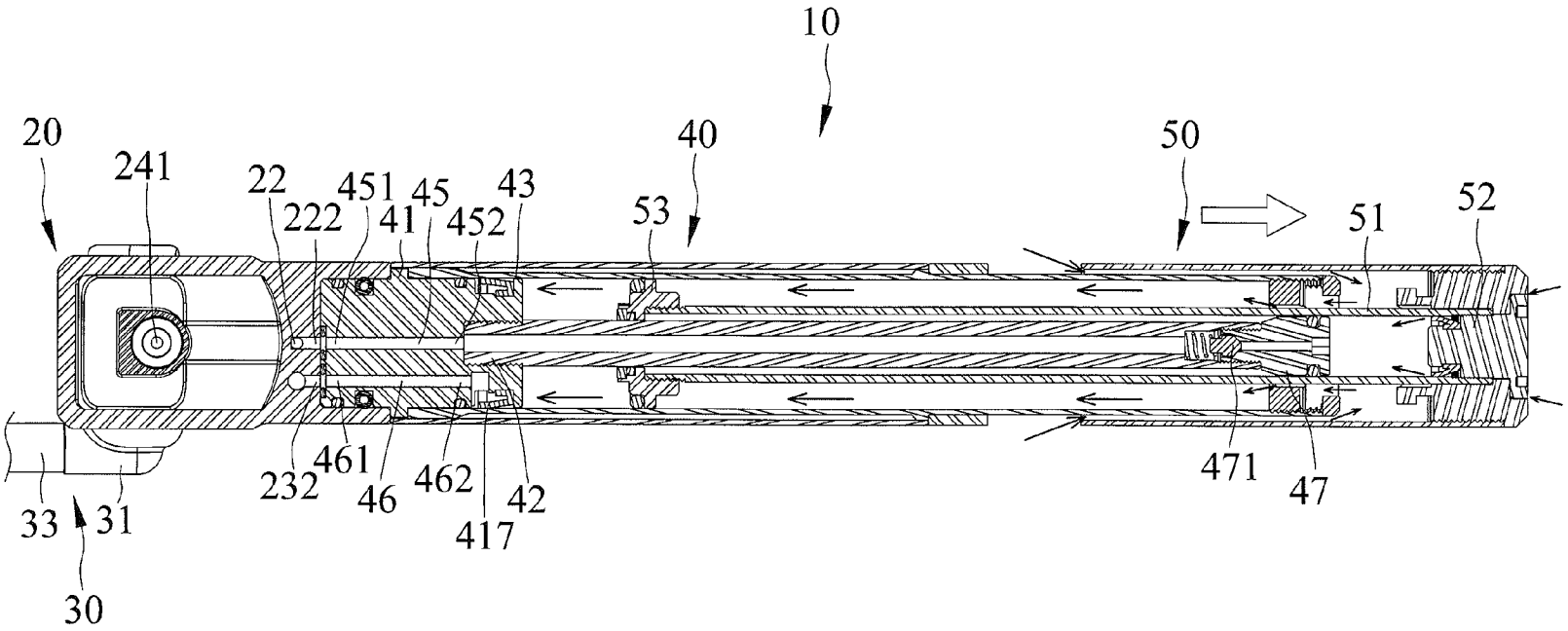
FIG. 14 is a cross-sectional view showing the compact manual pump of FIG. 10 switched to the high pressure pumping mode and suctioning air.
Figure 15:
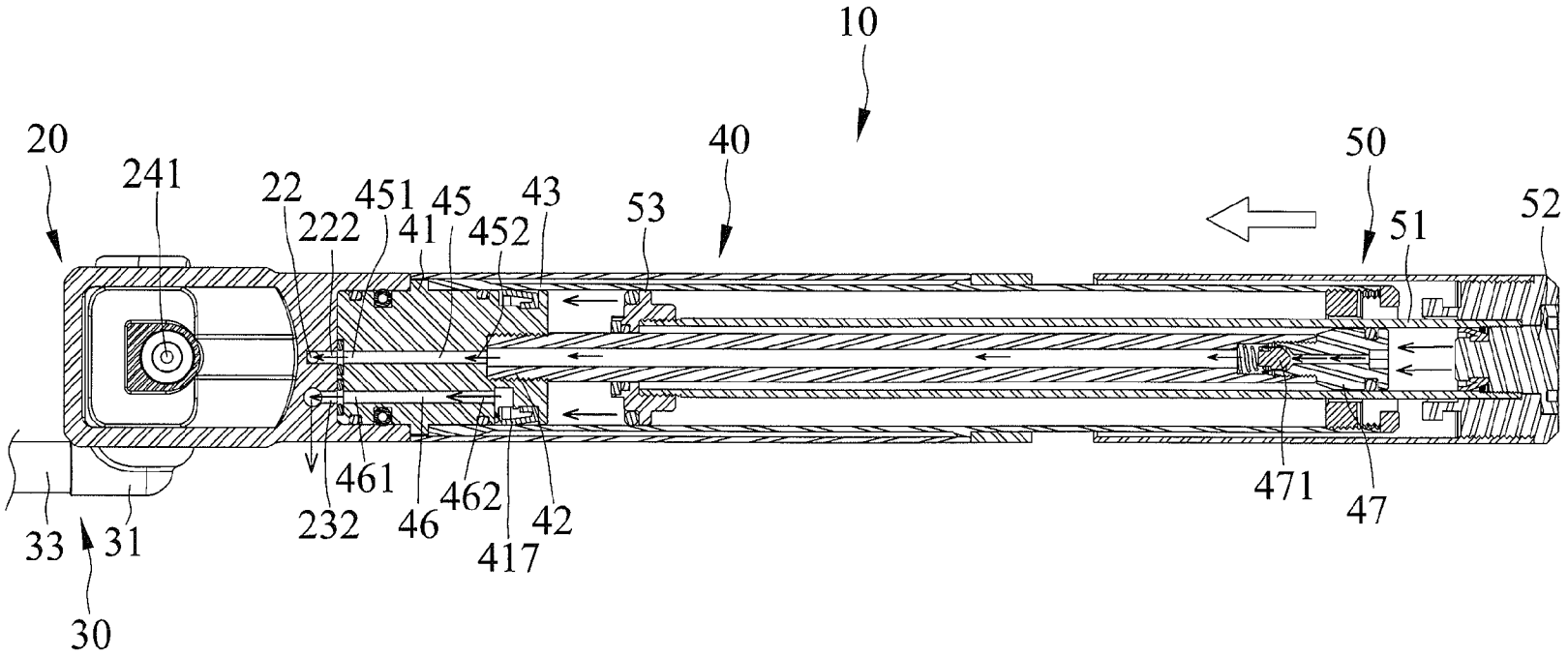
FIG. 15 is a cross-sectional view showing the compact manual pump of FIG. 10 switched to the high pressure pumping mode and aerating air.
Figure 16:
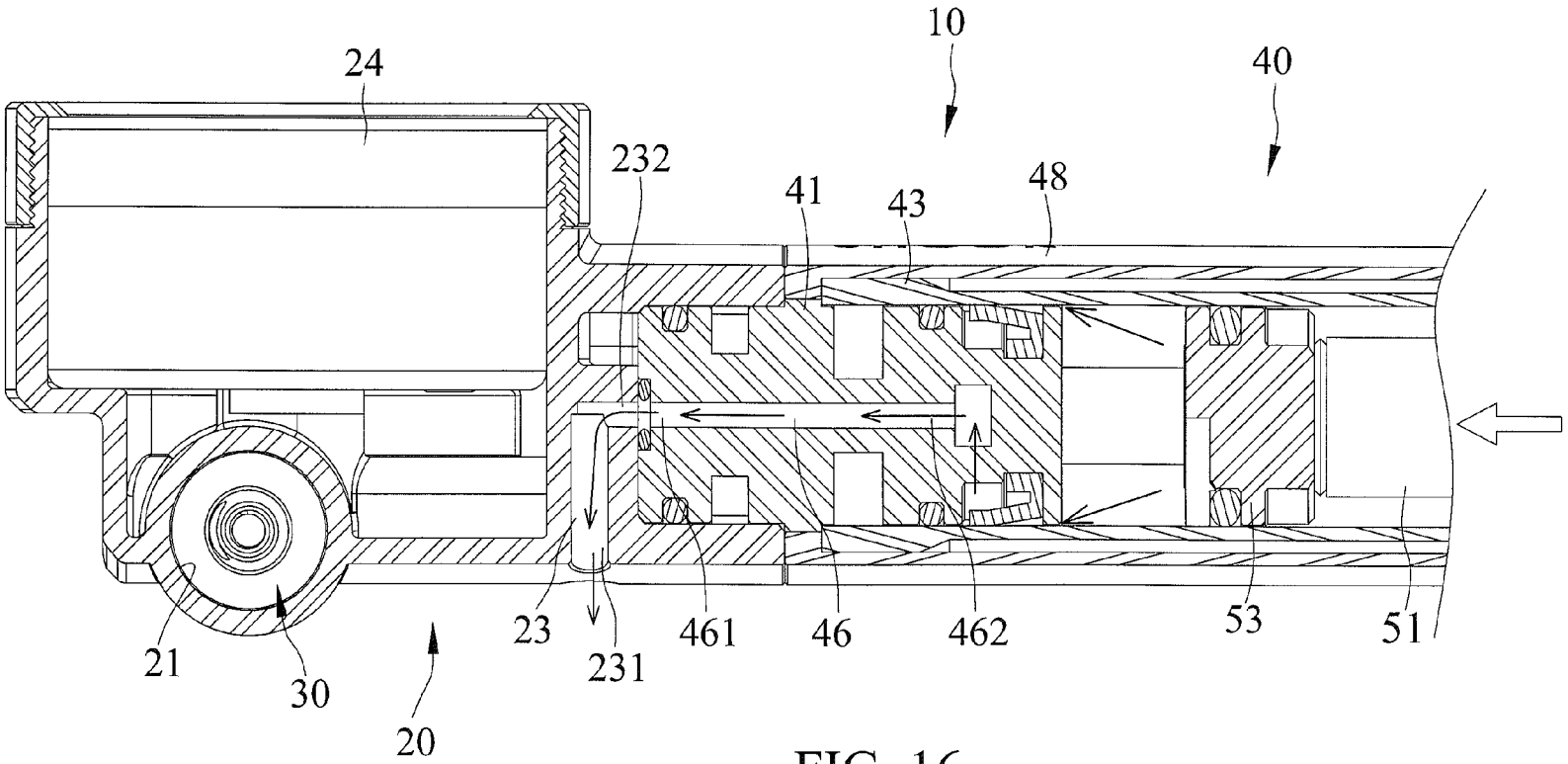
FIG. 16 is a partial, enlarged cross sectional view of FIG. 15.

Referring to FIGS. 10 through 16, the first cylinder assembly 40 is rotatable with respect to the body 20 to switch from low pressure pumping mode to high pressure pumping mode, so that it is fast and very convenient for the user to switch modes. The second level side 415 is abutted against the one of the restricting pin 44 to switch to high pressure pumping mode. While the first cylinder assembly 40 is rotated to switch to high pressure pumping mode, the first inflating inlet 451 is connected with the first collect inlet 222, and the second inflating inlet 461 is connected with the exhaust outlet 232, and the second collect inlet 223 is blocked by the seat 41. While the first cylinder assembly 40 is rotated to switch to high pressure pumping mode, the second cylinder assembly 50 is moved opposite to the first cylinder assembly 40 to induce air from the atmosphere passing through the second piston 53 into the outer cylinder 43 and the space formed between the inner cylinder 42 and the seat 41. Simultaneously, air is induced passing through the intake valve 52 into the space formed between the hollow bar 51 and the first piston 47.

While the first cylinder assembly 40 is rotated to switch to high pressure pumping mode, the second cylinder assembly 50 is moved to close to the first cylinder assembly 40, air in the second piston 53, the outer cylinder 43, and the space formed between the inner cylinder 42 and the seat 41 is urged past the first non-return ring 417, so that air passes through the second inflating outlet 462, the second inflating channel 46, the second inflating inlet 461, and the exhaust outlet 232 into the exhaust channel 23. Simultaneously, air in the space formed between the hollow bar 51 and the first piston 47 passes through the check valve 471, the inner cylinder 42, the first inflating outlet 452, the first inflating channel 45, the first inflating inlet 451, and the first collect inlet 222 into the collect channel 22. Hence, air passing through the second inflating channel 46 into the exhaust channel 23 is urged past through exhaust inlet 231 into the atmosphere. Because the collect channel 22 only collects air flowing from the first inflating channel 45 so that the compact manual pump 10 is able to inflate an object by the valve assembly 30 for high pressure/low volume pumping operation. Additionally, while air flows through the pressure channel 241, the pressure gauge 24 provides to measure air pressure. Generally, the compact manual pump 10 switched to high pressure pumping mode is used with a shock absorber.

In view of the foregoing, it is an object of the present invention that the compact manual pump 10 is selectable for low pressure and high pressure pumping modes.

It is another object of the present invention that the first cylinder assembly 40 is rotatable with respect to the body 20 to immediately switch to low pressure and high pressure pumping modes It is a further object of the present invention that the compact manual pump 10 is compact and can create a flush outlook for aesthetic reason.

Thus since the invention disclosed herein may be embodied in other specific forms without departing from the spirit or general characteristics thereof, some of which forms have been indicated, the embodiment described herein is to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A compact manual pump having selectable low pressure and high pressure pumping modes comprising:

a body defined a first axis, with the body having first and second ends, with the first and second ends extending along the first axis and disposed opposite to each other, with the body including a chamber located at the first end and passing through two opposite sides thereof, collect and exhaust channels disposed separately, with the collect channel including a collect outlet connected with the chamber, first and second collect inlets disposed adjacent to the second end, with an axis of the first collect inlet located along the first axis, with an axis of the second collect inlet located at a first position radially spaced from the first axis, with a first radial distance defined between the axis of the first collect inlet and the axis of the second collect inlet, with the exhaust channel including an exhaust inlet connected with an exterior surface of the body and an exhaust outlet disposed at the second end, with an axis of the exhaust outlet located at a second position radially spaced from the first axis, with a second radial distance defined between the axis of the exhaust outlet and the axis of the first collect inlet, with the second radial distance equal to the first radial distance;

a valve assembly for connecting a valve allowed to inflate connected with the chamber;

a first cylinder assembly pivotally connected with the second end of the body and rotatable with respect to the body about the first axis to switch between low pressure and high pressure pumping modes, with the first cylinder assembly including a seat, inner and outer cylinders, with an inner diameter defined in the inner cylinder less than an inner diameter defined in the outer cylinder, with the seat including pivoting and connecting ends extending along the first axis and disposed opposite to each other, with the pivoting end pivotally connected with the second of the body, with the seat including first and second inflating channels not connected with each other therein, with the first inflating channel including a first inflating inlet disposed at the pivoting end, with an axis defined in the first inflating inlet extending along the first axis, with the second inflating channel including a second inflating inlet, with a third radial distance defined between an axis defined in the second inflating inlet and the axis defined in the first inflating inlet, with the third radial distance equal to the first radial distance, with an end of the inner cylinder connected with the a central portion of the connecting end, with an end of the outer cylinder connected with a periphery of the connecting end, wherein a non-circular shaped groove is formed at a peripheral edge of the pivoting end, wherein an annular wall is formed at the second of the body and adapted to surround the peripheral edge of the pivoting end, with the annular wall including two through holes disposed opposite to the groove, with the two through holes penetrating to the annular wall, with a pair of restricting pins respectively disposed through the through holes and the groove to limit the seat rotatable in the annular wall and not slidable along the first axis, with the groove including first and second level sides selectively abutted against the pair of restricting pins respectively; and a second cylinder assembly movable reciprocally with respect to the first cylinder assembly to induce air from the atmosphere into the first and second cylinder assemblies;

wherein while the first cylinder assembly is rotated to switch to low pressure pumping mode, the first inflating inlet is connected with the first collect inlet and the second inflating inlet is connected with the second collect inlet and the exhaust outlet is blocked by the seat and the first level side is abutted against the restricting pin;

wherein while the first cylinder assembly is rotated to switch to high pressure pumping mode, the first inflating inlet is connected with the first collect inlet and the second inflating inlet is connected with the exhaust outlet and the second collect inlet is blocked by the seat and the second level side is abutted against the one of the restricting pin.

2. The compact manual pump as claimed in claim 1, wherein an included angle formed between the first and second radial distances is 90 degrees, wherein the first and second level sides extend longitudinally to form an included angle equal to 90 degrees, with the seat able to be rotated with respect to the body about 90 degrees.

3. The compact manual pump as claimed in claim 2, wherein the first inflating channel includes a first inflating outlet disposed at the connecting end, with an axis defined in the first inflating outlet located on the first axis, with the first inflating outlet connected with the inner cylinder.

4. The compact manual pump as claimed in claim 3, wherein the second inflating channel includes a second inflating outlet, with a fourth radial distance defined between an axis defined in the second inflating outlet and the axis defined in the first inflating outlet, with the fourth radial distance equal to the third radial distance, with the seat further including an annular trough formed on the periphery of the connecting end and a first non-return ring for backflow prevention mounted between the annular trough and the outer cylinder.

5. The compact manual pump as claimed in claim 4, wherein the second cylinder assembly includes a hollow bar, an intake valve mounded on an end of the hollow bar, with a second non-return ring mounted between the intake valve and the hollow bar to prevent air flowing from the hollow bar to the atmosphere.

6. The compact manual pump as claimed in claim 5, wherein the inner cylinder includes a first piston disposed opposite to the seat therein, with a check valve for backflow prevention mounted between the first piston and the inner cylinder, with an inner surface of the hollow bar is contacted with a periphery surface of the first piston to allow air flowing through the first piston in only one direction;

wherein a second piston mounted on the hollow bar and disposed between the inner and outer cylinders to provide the hollow bar securely located between the inner and outer cylinders, with inner and outer surfaces of the second piston respectively contacted with the inner and outer cylinders to allow air flowing through the inner and outer cylinders in only one direction.

7. The compact manual pump as claimed in claim 6, wherein the end of the outer cylinder is connected with a periphery of the connecting end by two screws, with the outer cylinder including a first cap disposed opposite to the seat, with at least one slot formed in the first cap, with a second cap mounted on a periphery of the intake valve, with an end of the second cap connected with at least one block selectively engaged with the at least one slot to provide the second cylinder assembly selectively located at and not movable reciprocally with respect to the first cylinder assembly.

8. The compact manual pump as claimed in claim 7, wherein a first sleeve is disposed on a periphery of the first cylinder assembly, wherein a second sleeve is disposed on a periphery of the second cylinder assembly, with an external diameter defined on the first sleeve equal to an external diameter defined on the second sleeve.

9. The compact manual pump as claimed in claim 8, wherein the body defines a second axis extending and vertically intersected with the first axis therein, with the chamber further including an axis extending through two opposite ends thereof and disposed vertical with and not intersected with the first and second axes, with the body having third and fourth ends, with the third and fourth ends extend along the second axis and disposed opposite to each other, with a pressure gauge disposed at the third end, with the chamber disposed adjacent to the fourth end, with the pressure gauge including a pressure channel connected with the chamber.

10. The compact manual pump as claimed in claim 9, wherein the valve assembly includes a joint, a nozzle head, and a flexible tube connected between the joint and the nozzle head, with the joint formed in a L shape and pivotally connected with the chamber by a fastener, wherein a user can rotate the nozzle head to a suiting position for connecting a valve allowed to inflate, with a clamp mounted on the periphery of the first cylinder assembly to fix the flexible tube.

11. The compact manual pump as claimed in claim 2, wherein the first cylinder assembly further includes first, second, and third airtight rings disposed between the pivoting end of the seat and the second end of the body;

wherein while the first cylinder assembly is rotated to switch to low pressure pumping mode, with the first airtight ring disposed between the first inflating inlet and the first collect inlet, with the second airtight ring disposed between the second inflating inlet and the second collect inlet, with the third airtight ring disposed between the pivoting end and the second collect inlet to provide airtightness.

* * * * *